United States Patent [19]

Paxton et al.

[11] 4,262,177

[45] Apr. 14, 1981

[54] SENSOR ASSEMBLY

[75] Inventors: Wayne E. Paxton; Henry Y. Suzuki; Lawrence D. Tuchscherer, all of Goleta, Calif.

[73] Assignee: General Motors Corporation, Detroit, Mich.

[21] Appl. No.: 51,449

[22] Filed: Jun. 25, 1979

[51] Int. Cl.[3] ..... H01H 35/14

[52] U.S. Cl. ..... 200/61.45 R; 200/61.48; 200/61.49; 200/61.51

[58] Field of Search ..... 200/61.45 R, 61.45 M, 200/61.48, 61.49, 61.51, 61.52

[56] References Cited

U.S. PATENT DOCUMENTS

| | | | |
|---|---|---|---|
| 3,647,999 | 3/1972 | Mazelsky | 200/61.45 R |
| 3,678,763 | 7/1972 | Brooks et al. | 200/61.45 M X |
| 3,710,051 | 1/1973 | Orlando | 200/61.45 R |
| 3,717,731 | 2/1973 | Porter et al. | 200/61.45 M |
| 3,717,732 | 2/1973 | Porter | 200/61.45 M |

*Primary Examiner*—James R. Scott
*Attorney, Agent, or Firm*—Herbert Furman

[57] ABSTRACT

A pendulum type sensor includes a housing having a plurality of recesses, each receiving a sensor module. The sensor module includes a mass assembly, a spacer assembly and a contact assembly sandwiched together and secured to each other. Each assembly includes a support defining an enclosure, with the mass assembly enclosure receiving a sector shaped recess of the spacer assembly to locate the mass and deflectable wire of the mass assembly in an unactuated preload position. The contact assembly includes a plurality of contact fingers engaged by the mass upon movement to actuated position and an ultimate stop which prevents turning moments on the mass upon engagement of the contact fingers with the ultimate stop under the force of the mass.

4 Claims, 13 Drawing Figures

SENSOR ASSEMBLY

FIELD OF INVENTION

This invention relates generally to acceleration responsive sensors and more particularly to pendulum type acceleration responsive sensors.

BACKGROUND OF THE INVENTION

Pendulum type sensors of the general type disclosed herein are shown in U.S. Pat. Nos. Porter et al 3,717,731 issued Feb. 20, 1973; Porter 3,717,732 issued Feb. 20, 1973; Brooks et al 3,678,763 issued July 23, 1972; Orlando 3,710,051 issued Jan. 9, 1973; and U.S. patent application Ser. No. 002,946 filed Jan. 12, 1979. Generally such sensors include an acceleration responsive mass which is suspended by a deflectable wire with a sector shaped recess. Either a magnet or the deflection of the wire or both provides a preload bias on the mass normally locating the mass in unactuated position in engagement with the walls of the recess adjacent the proximal end thereof. Electrical contacts located adjacent the distal end of the recess are engaged by the mass to close an electrical circuit when the mass is subjected to a pulse of predetermined amplitude and time sufficient to overcome the preload bias and move the mass through the recess and into engagement with the contacts.

SUMMARY OF THE INVENTION

A primary feature of this invention is that it provides a sensor module which is unit assembled prior to being installed in a housing. Another feature is that the module includes a mass assembly, a contact assembly, and a spacer assembly sandwiched therebetween and securing the assemblies to each other to assemble the module. A further feature is that the mass assembly includes a hanger supporting and encircling the deflectable wire and mass to avoid changes in natural frequency of the mass and wire due to distortion. Yet another feature is that the hanger of the mass assembly includes a generally rigid plate defining an integral enclosure, with the mass and wire being centered laterally relative to the enclosure. Yet a further feature is that the spacer assembly includes a sector shaped recess receiving the mass and setting the preload force on the mass as well as the travel distance of the mass to engagement with contact fingers of a contact of the contact assembly. Still another feature is that the spacer assembly and the contact assembly cooperatively set the preload force on the contact fingers of the contact. Still a further feature is that the spacer assembly permits both the preload force on the mass, the spring rate of the wire and mass, and the mass travel distance to contact to be checked after assembly of the sensor module and before or after installation in the housing. Yet another feature is that the contact assembly includes a hanger secured to the body portion of the contact to obviate axial shifting of the contact as well as to locate the contact fingers in a predetermined position relative to a contact finger engageable portion of the spacer assembly to set the contact preload on such fingers. Another primary feature of this invention is that it provides a pendulm type sensor having means limiting movement of the mass and controlling deflection of mass engageable contact fingers to prevent any rotational moment on the mass tending to separate the mass from its deflectable support wire and to obviate high stress levels in the contact fingers. Yet a further feature is that the mass engaged contact fingers planar engage the limiting means upon engagement and deflection of such contact fingers by the mass to thereby control bending of the contact fingers relative to the body portion of the contact member and high stress levels in such fingers, with the mass moving along a path generally normal to the limiting means to thereby obviate any turning moments on the mass tending to separate the mass from the deflectable wire. Still another feature, in one embodiment, is that the mass assembly, contact assembly, and spacer assembly have three common mounting locations for mounting of the sensor module in a housing. Still a further feature is that the spacer assembly in one embodiment, loosely secures the mass assembly and the contact assembly to it prior to mounting of the module within a housing, with such mounting providing the final alignment of the various assemblies of the module. Yet another feature, in one embodiment, is that the contact fingers are continuously backed up upon deflection of the fingers by the mass in order to control the deflected shape of the fingers and avoid high stress levels in certain areas of the fingers.

BRIEF DESCRIPTION OF THE DRAWINGS

These and other features of the sensor assembly of this invention will be readily apparent from the following specification and drawings wherein.

BRIEF DESCRIPTION OF THE PREFERRED EMBODIMENTS

Figure 1:
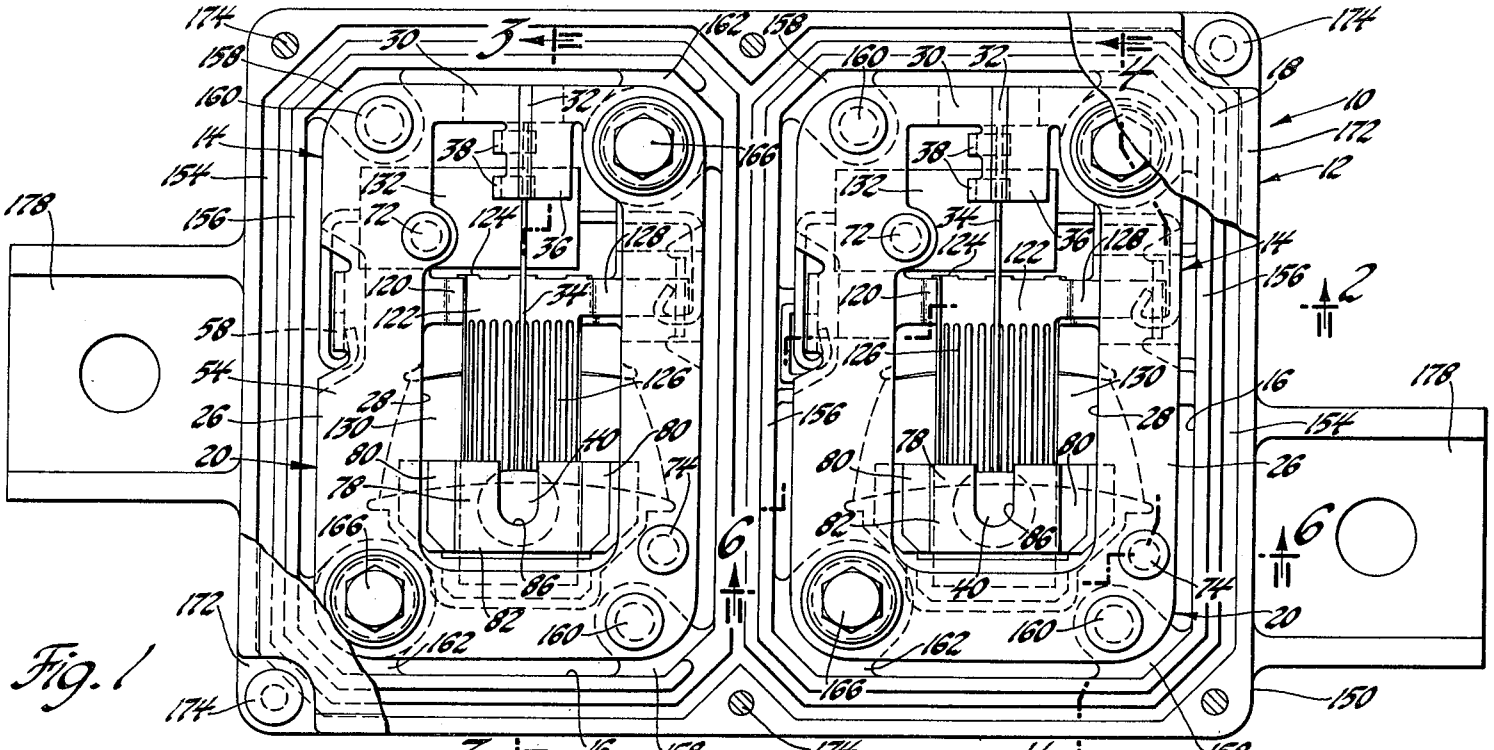
FIG. 1 is a partially broken away front elevational view of a sensor assembly according to this invention.
Figure 2:
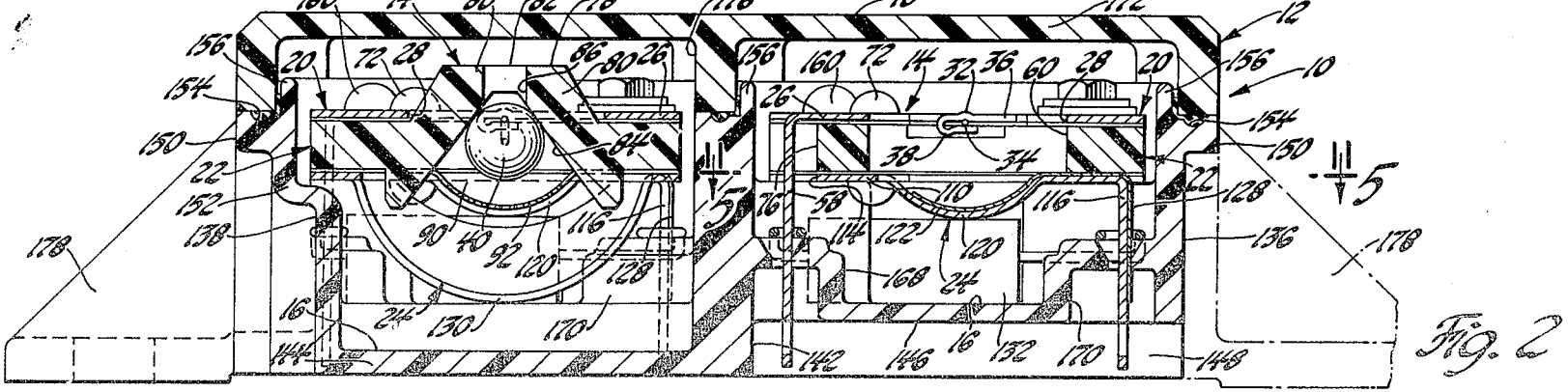
FIG. 2 is a sectional view taken generally along the plane indicated by line 2—2 of FIG. 1.

Referring now particularly to FIGS. 1 and 2 of the drawings, a sensor assembly 10 according to this invention includes a housing 12 which encloses a pair of like side by side sensor modules 14. Each module is installed within a respective recess 16 of the housing 12 with these recesses being closed by a common cover 18 after assembly of the modules to the housing 12 as will be described. Since each of the sensor modules 14 is of the same construction, like numerals will be used for like parts and the modules will be described as right hand or left hand, as necessary.

Figure 7:
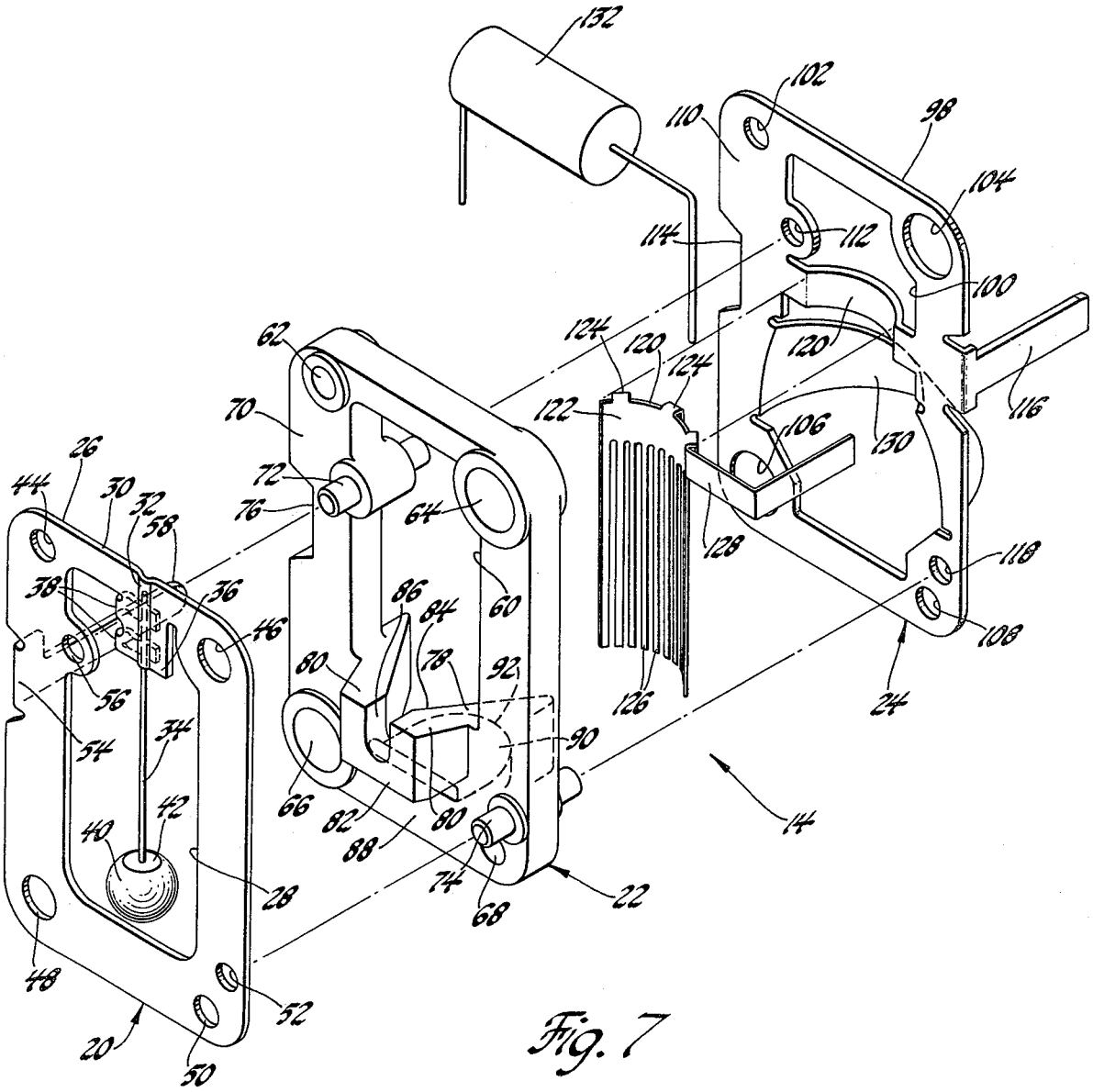
FIG. 7 is an exploded perspective view of one of the sensor modules of the sensor assembly.

As best shown in FIG. 7, each sensor module 14 generally comprises a mass assembly 20, a spacer assembly 22, and a contact assembly 24. The spacer assembly is sandwiched between the mass assembly and contact assembly and secures all the assemblies to each other as will be described.

As shown in the drawings, the mass assembly 20 includes a generally rigid plate or hanger 26 of generally rectangular shape which defines an integral opening 28. The upper leg 30 of plate 26 is provided with a shallow rearwardly opening arcuate rib 32 which receives the upper end portion of a wire 34. An integral depending ribbed portion 36 of leg 30 is provided with integral tabs 38 which are bent over wire 34 so as to crimp the wire to the leg 30 and the portion 36 thereof. After crimping, the upper end portion of the wire is additionally soldered to the leg 30 and the portion 36. The longitudinal axis of wire 34 is located in a plane parallel to the plane of the hanger 26. The lower end portion of the wire 34 is secured to a truncated ball or mass 40. The wire 34 may either be soldered to the flat 42 of mass 40 or may extend completely or partially through the mass and be soldered thereto.

The upper left hand and right hand corner portions of hanger 26 are provided with respective openings 44 and 46, FIG. 7, and the lower left hand and right hand corner portions are provided with respective openings 48 and 50. The lower right hand corner portion is provided with an additional opening 52 and the intermediate portion of the left hand leg 54 of hanger 26 is provided with an integral ear having an opening 56. Leg 54 further includes an integral rearwardly extending elongated ear 58 which provides an electrical connector as will be described.

Hanger 26 is former of metal and is of sufficient thickness so as to prevent warping or twisting of the plate about various vertical and horizontal axes. By providing the hanger of rectangular shape with an integral enclosure or opening 28, sufficient rigidity is imparted to the plate while permitting the mass assembly, which comprises the wire 34 and mass 40, to move laterally relative to the hanger.

The spacer assembly 22, FIG. 7, is formed of plastic and is much thicker than the hanger 26. This assembly is generally of rectangular shape and defines an integral enclosure 60 which is generally aligned with the opening 28 when the spacer assembly is sandwiched between the mass assembly and the contact assembly as will be further described. The spacer assembly includes openings 62 and 64 in its respective upper left hand and right hand corner portions which are respectively alignable with the openings 44 and 46 of plate 26. Additionally the spacer assembly includes openings 66 and 68 in its respective lower left hand and right hand corner portions which are respectively alignable with the openings 48 and 50 of plate 26. An integral tab of the left hand side leg 70 of the spacer assembly includes integral oppositely extending aligned ears 72. Additionally, the right hand side leg of the spacer assembly includes integral oppositely extending aligned ears 74. The left hand leg 70 is cut away at 76 to provide clearance for ear 58.

Figure 3:
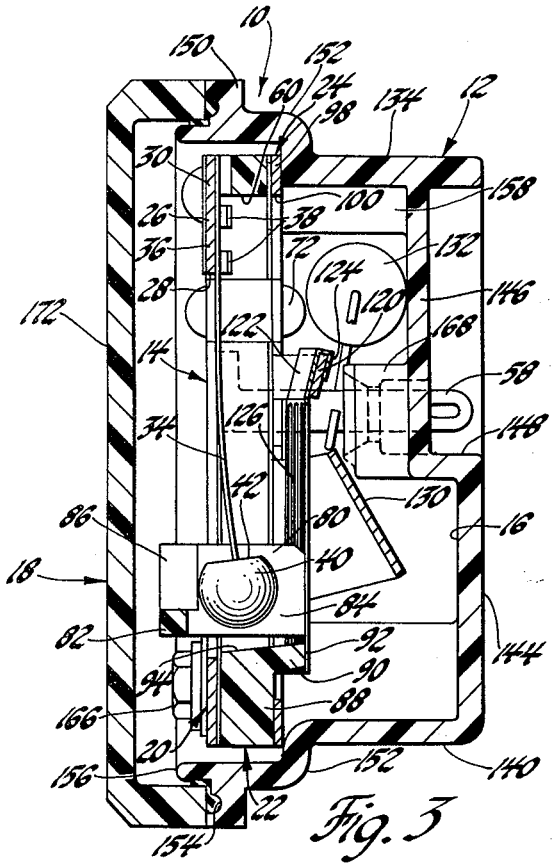
FIG. 3 is a sectional view taken generally along the plane indicated by line 3—3 of FIG. 1.

As best shown in FIGS. 2, 3 and 7, a mass housing 78, formed integral with the side legs of the spacer assembly at the lower end of the opening 60, includes a pair of angularly related legs 80 which extend to opposite sides of the aperture 60 and have their forward ends interconnected by a leg 82. The inner walls of the legs 80 define a sector shaped recess 84 for receiving the mass 40, as will be described. The leg 82 as best shown in FIGS. 1 and 7 is provided with a slot 86 opening upwardly thereof. As best shown in FIG. 3, the lower leg 88 of the spacer assembly 22 is provided with an integral rearwardly extending lip 90, the rear edge 92 of which is formed on an arc having its point of generation coplanar with a bi-sector of the recess 84. It will be noted with reference to FIG. 3 that the upper wall 94 of lip 90 is formed at an angle of approximately 10° to the horizontal while the lower wall is formed at an angle of approximately 15° to the horizontal.

The contact assembly 24 includes a plate or hander 98 of generally rectangular shape defining an opening 100. The hanger 98 includes openings 102 and 104 in its upper left hand and right hand corner portions respectively, with these openings being alignable respectively with the openings 44 and 62, and 46 and 64. The hanger further includes openings 106 and 108 in its lower left hand and right hand corner portions respectively, which are respectively alignable with the openings 48 and 66 and the openings 50 and 68. An ear on the left hand side leg 110 of hanger 98 is provided with an opening 112 alignable with the opening 56 of hanger 26 and receiving the rearwardly extending ear 72 of the spacer assembly 22. The left hand side leg 110 is cut away at 114 to provide clearance for the tab 58 of plate 20 and the right hand side leg of the plate is provided with a rearwardly extending lateral tab 116 and an opening 118 alignable with opening 52 and receiving the rearwardly extending ear 74.

An integral transverse leg 120 of arcuate shape interconnects the side legs of hanger 98. The leg 120 is angled to the vertical at approximately 8°–10° as can be seen in FIG. 3. A contact 122 has its body portion provided with a plurality of integral tabs 124 which are hooked over the upper edge of leg 120 and soldered thereto. The contact 122 includes a plurality of depending fingers 126 which are slightly spaced from each other as clearly shown in FIGS. 1 and 5. The contact 122 further includes an integral lateral tab 128 which follows along leg 120 and tab 116.

The contact 122 is formed in the flat. When this contact is mounted on the leg 120, the body portion of the contact assumes the shape of the leg 120 and tab 128 is bent to the shape of leg 120 and tab 116 and secured thereto. The fingers 126 engage the edge 92 of lip 90 and assume an arcuate cross-sectional shape under a preload. The preload occurs from the angularity of leg 120 to the vertical, FIG. 3, and the relationship of edge 92 thereto. The upper portions of the fingers bow slightly adjacent the body portion of the contact.

Figure 5:
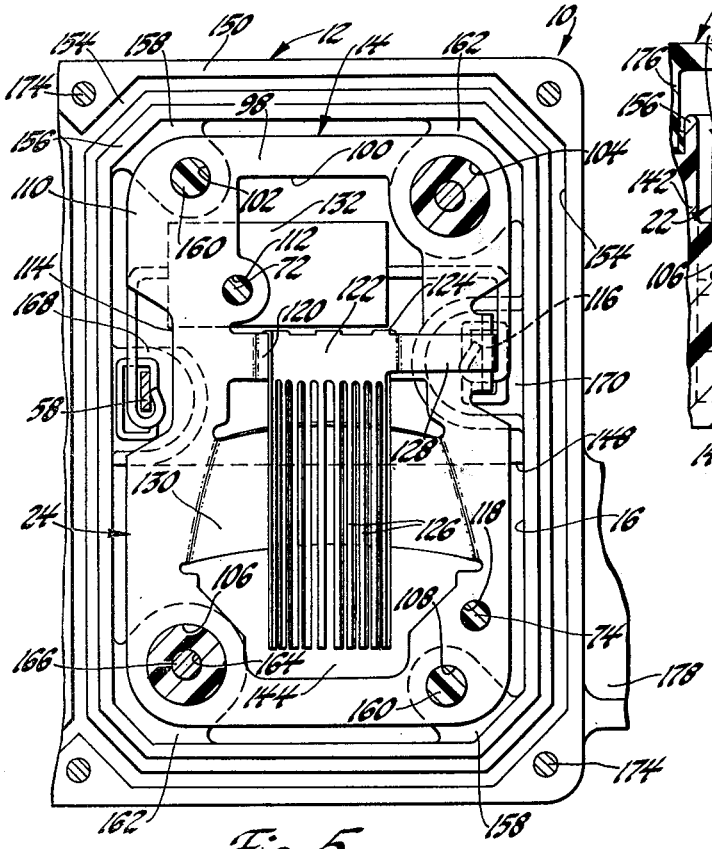
FIG. 5 is a view taken generally along the plane indicated by line 5—5 of FIG. 2.
Figure 6:
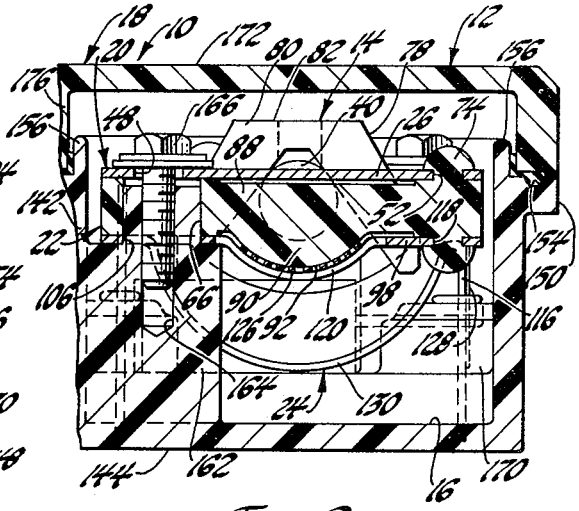
FIG. 6 is a sectional view taken generally along the plane indicated by line 6—6 of FIG. 1.

As best shown in FIGS. 3, 5 and 6, the hanger 98 further includes an integral transverse leg 130 of arcuate cross-section and located angularly to the vertical. The leg 130 is normally spaced rearwardly of the contact fingers 126 and provides an ultimate stop for these fingers and for the mass 40 as will be further described.

After the mass assembly 20, the spacer assembly 22 and the contact assembly 24 have been individually manufactured, they are assembled in a sensor module. The spacer assembly 22 is sandwiched between the mass assembly 20 and the contact assembly 24 with the apertures 44, 62 and 102; 46, 64 and 104; 48, 66 and 106; and 50, 68 and 108 respectively aligned with each other.

The openings 56 and 112 are likewise aligned with each other and each receives a respective ear 72 of the spacer assembly. Likewise the openings 52 and 118 are aligned with each other and each receives a respective ear 74 of the spacer assembly 22. The ears 72 and 74 are then heat staked over the hangers 26 and 98 to thereby secure the assemblies to each other.

When the sensor module is assembled, the recess 84 traverses the enclosure 28 of hanger 26. The mass 40 is received within the recess 84 in tangential engagement with the inner walls of the recess adjacent the proximal end thereof as shown in FIGS. 2 and 6. The engagement of the mass with the walls of the recess deflects or bends the wire 34 from the vertical to thereby provide a preload on the mass locating the mass in its unactuated position as shown in these figures. In the specific embodiment shown, the mass is located in unactuated position by a preload of 5½ G and the natural frequency of the mass and the free portion of wire 34 is 30 Hz.

It will be recalled that the leg 82 which integrally interconnects the legs 80 is provided with a slot 86. After assembly of the sensor module, this slot permits a contact probe to engage the mass 40 and check preload, spring rate, and mass travel distance to contact. Thus the sensor module can be calibrated prior to mounting within the housing 12 of the sensor assembly. The portion 36 of the leg 30 of hanger 26 is bent relative to the leg in order to set the preload on the mass 40.

The cutaways 76 and 114 of the spacer assembly 22 and hanger 98, respectively, provide clearance for tab 58 so that it can project rearwardly of the module in parallel spaced relationship to tab 116.

Figure 4:
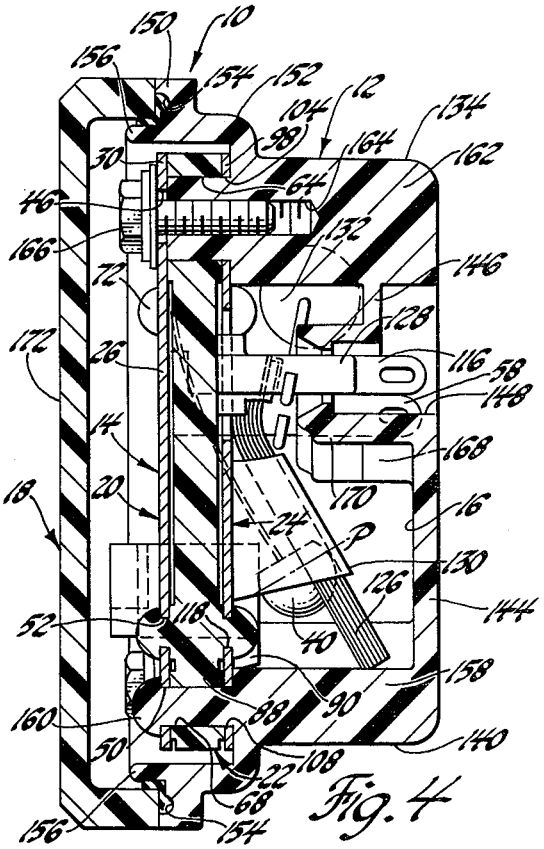
FIG. 4 is a view taken generally along the plane indicated by line 4—4 of FIG. 1 and showing the mass in actuated position.

As best shown in FIGS. 3, 4, and 5, a resistor 132 is connected between the tabs 58 and 116 of the mass assembly and contact assembly after completion of the sensor module. This resistor is also connected across the tab 128 of the contact 122 so that it can monitro this contact. As shown in FIGS. 2 and 7, the thickness of the hanger 98 and its integral tab 116 is much greater than that of the tab 128 of the contact 122. By supporting the tab 128 on the tab 118, it is possible for the resistor to be connected across the tab 128 without distorting or bending this tab.

The housing 12 is formed of molded plastic and includes a continuous integral outer wall having an upper wall portion 134, right hand and left hand wall portions 136 and 138 respectively, FIGS. 1 and 2, and a lower wall portion 140, FIGS. 3 and 4. The upper and lower wall portions 134 and 140 are further interconnected by an integral intermediate wall portion 142, FIG. 2, to define, with wall portions 136 and 138, the recesses 16. A stepped base or rear wall of each recess 16 includes a lower wall portion 144 and an upper wall portion 146 joined by an intermediate wall portion 148. Wall portion 136 is provided with an integral flange 150 and a continuation of this flange is provided on wall portions 134, 138 and 140 through an offset portion 152 respective to each of these wall portions. A forwardly opening groove 154 is provided in this flange and in the forward edge of wall portion 142 around each recess 16, with the groove in the wall portion 142 being common to each recess. A continuous lip 156 is located within the groove around the right hand recess 16 and a partial lip 156 is located around the left hand recess 16, the lip 156 provided along the wall portion 142 being common to both recesses.

Each recess 16 includes transversely arranged like integral bosses 158 at its upper left hand and lower right hand corners, with each boss including an integral cylindrical ear 160. Each cavity 16 additionally includes like integral bosses 162 at its lower left hand and upper right hand corners, each of which is provided with a bore 164, FIG. 4.

A sensor module 14 is located in each of the right hand and left hand recesses 16. The aligned openings 44, 62 and 102 of each module are received on the ear 160 of the upper left hand boss 158 and the aligned openings 50, 68 and 108 are received on the like ear 160 of the lower right hand boss in each recess. These bosses serve to locate the sensor module within the recess. After being assembled thereon, the ears are heat staked over the sensor modules as shown in FIGS. 1 and 4 to thereby secure the sensor modules in their respective recesses. Bolts 166 extend through the aligned openings 46, 64 and 104 and the aligned openings 48, 66 and 106 and into bores 164 of bosses 162 to further secure the sensor modules 14 in their respective recesses.

It will be noted with reference to FIG. 2 that the tab 58 of each sensor module extends outwardly of a respective wall portion 146 through an apertured recessed wall of integral boss 168. Likewise, the tabs 116 and 128 of each module extend outwardly through a similar apertured recessed wall of an integral boss 170. The tabs 58 and 116 and 128 are sealed to the recessed walls as shown in FIG. 2 in a conventional manner. As shown in FIG. 4, the offsetting of wall portion 144 with respect to wall portion 146 provides space in the cavity for the integral leg 130 of the hanger 98.

After assembly of the sensor modules 14 within their respective recesses, a suitable sealant is placed in the groove 154 and a flanged cover 172 is then secured at a number of places 174 to the flange 150 outwardly of the sealant in the groove. The flange of the cover engaging the sealant forces the sealant outwardly of the groove as the cover flange seats on flange 150 to thereby provide an additional seal between the cover flange and the lip 156. The cover includes an intermediate flange 176, FIGS. 2 and 6, which seats on the wall portion 142. Apertured integral ears 178 provide for mounting of the sensor assembly on a structure to be sensed.

With reference now to FIGS. 3 and 4, when the sensor module 14 receives an acceleration pulse of predetermined amplitude and time, the mass 40 moves from its unactuated position of FIG. 3 rearwardly or to the right relative to the walls of recess 84 and into engagement with one or more of the fingers 126 of the contact 122 to complete a circuit across a source of power and a device to be actuated which are electrically connected across the tabs 58 and 116 in a conventional manner. Since the fingers 126 are cantilevered, the fingers are displaced from their FIG. 3 position to their FIG. 4 position and into engagement with the leg 130 which functions as an ultimate stop for the mass and the contact fingers. The engagement of the mass with the contact fingers is a wiping contact. With reference to FIG. 4, it will be noted that the movement of the mass relative to the leg 130 is in a plane P normal to the leg 130. This feature of having the mass move into engagement with leg 130 along a plane normal to the strap and through the center of the mass prevents counterclockwise turning moments on the mass which act to place the connection between the wire 34 and the mass in shear as well as providing an increased shear stress level in the remaining portion of the wire 34 which can result in calibration problems. Additionally, the fingers 126 of the contact 122 are not overly stressed to thereby avoid bending problems.

When the amplitude of the pulse is decreased, the bias of the wire 34 returns the mass 40 to its normal position in tangential engagement with the walls of recess 84.

Figure 8:
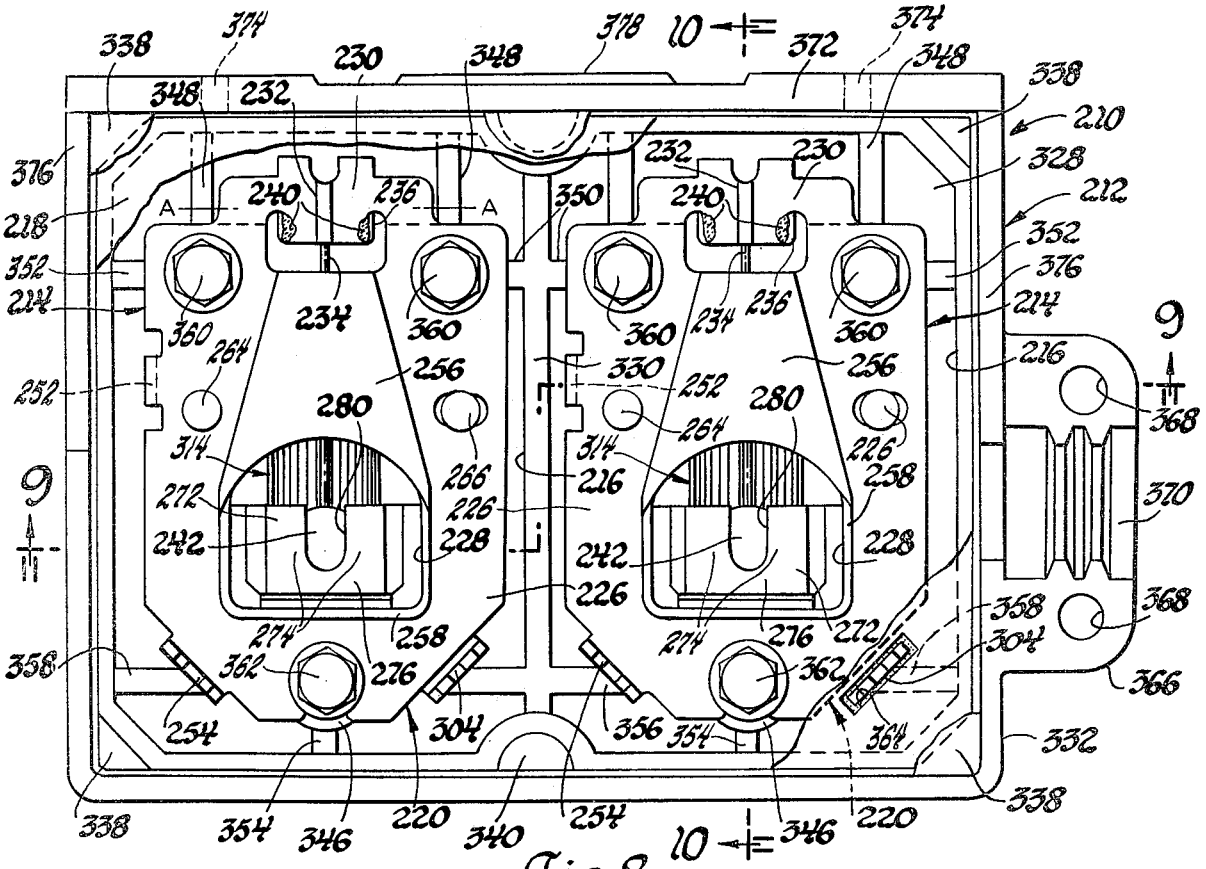
FIG. 8 is a partially broken away front elevational view of a sensor assembly according to another embodiment of this invention.
Figure 9:
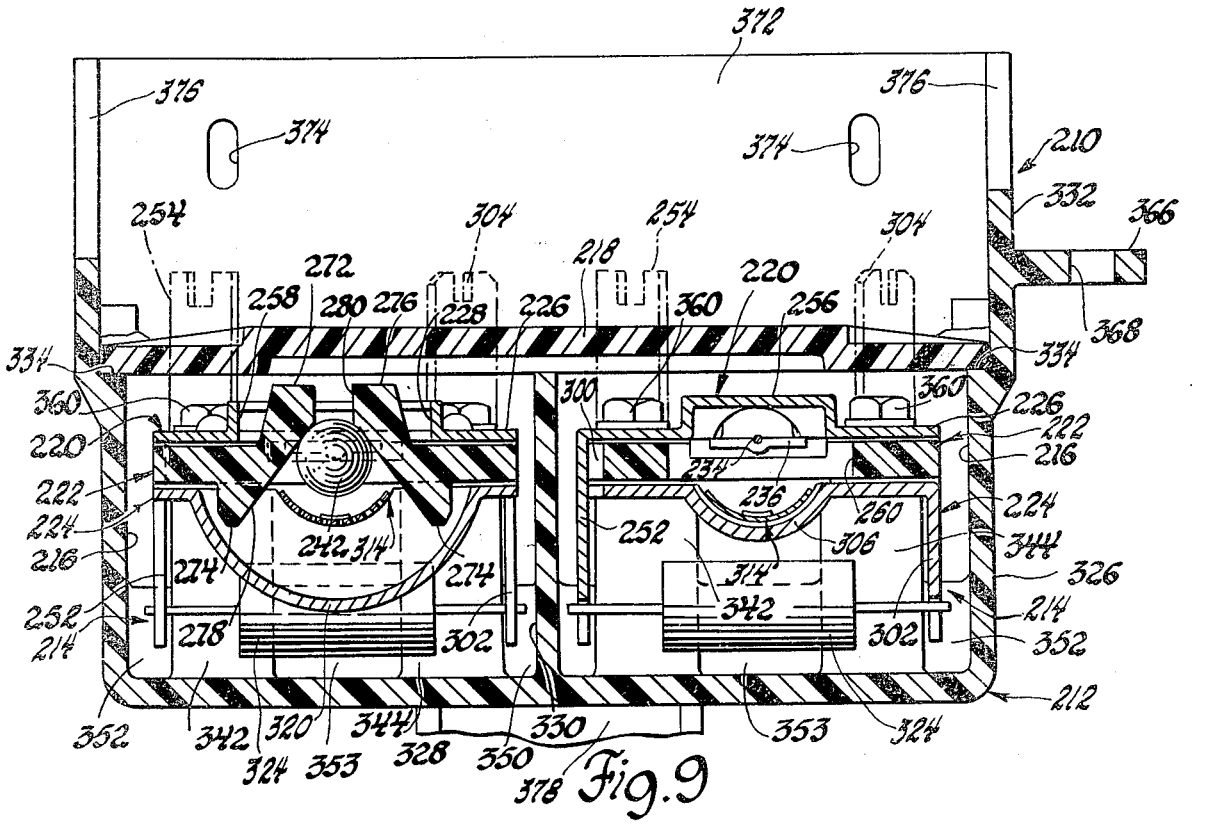
FIG. 9 is a sectional view taken generally along the plane indicated by line 9—9 of FIG. 8.

Referring now particularly to FIGS. 8 and 9 of the drawings, a sensor assembly 210 according to another embodiment of this invention includes a housing 212 which encloses a pair of like side by side sensor modules 214. Each module is installed within a respective recess 216 of the housing 212 with these recesses being closed by a common cover 218 after assembly of the modules to the housing 212 as will be described. Since each of the sensor modules 214 is of the same construction, like numerals will be used for like parts. The modules will be designated right hand or left hand as necessary.

Figure 13:
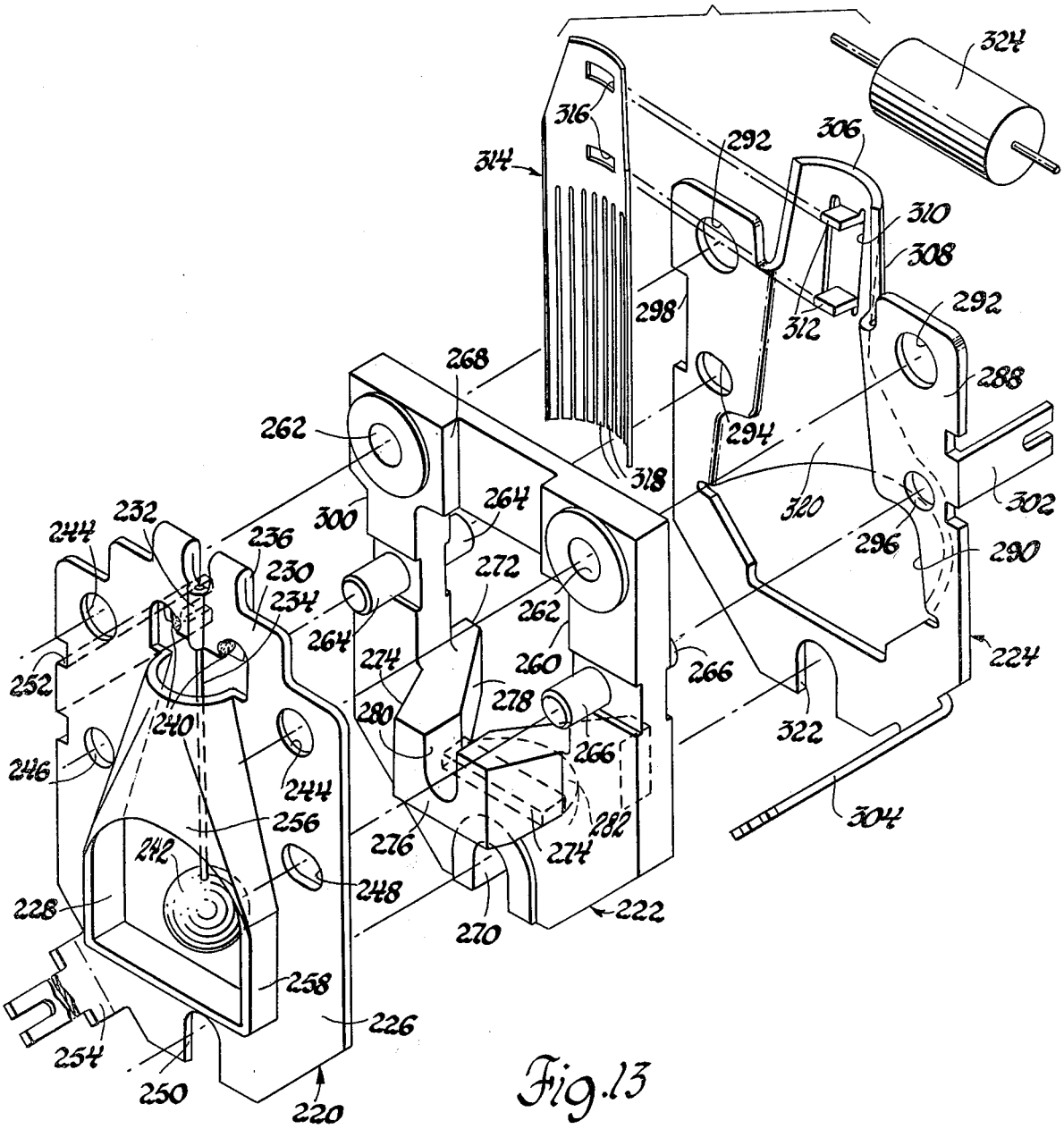
FIG. 13 is an exploded perspective view of one of the sensor modules of the sensor assembly.

As best shown in FIG. 13, each sensor module 214 generally comprises a mass assembly 220, a spacer assembly 222, and a contact assembly 224. The spacer assembly is sandwiched between the mass assembly and contact assembly and secures all the assemblies to each other as will be described.

The mass assembly 220 includes a generally rigid plate or hanger 226 of generally rectangular shape which defines an integral opening 228. The upper leg 230 of hanger 226 is provided with a shallow rearwardly opening arcuate rib 232 which receives the upper end portion of a wire 234. An integral slotted tab 236 of leg 230 is bent over wire 234 to hold the wire in rib 232. The upper end portion of the wire is soldered at 238 to the leg 230 through the slot in tab 236. The tab is soldered at 240, FIG. 8, to leg 230. The longitudinal axis of wire 234 is located in a plane parallel to the plane of hanger 226. The lower end portion of the wire is secured to a ball or mass 242. The wire may either extend completely or partially through the mass and is soldered thereto.

As shown in FIG. 13, the upper corner portions of hanger 226 are apertured at 244, the side legs are apertured at 246 and 248 with the right hand aperture 248 being elongated, and the lower leg is slotted at 250. The left hand leg is provided with a rearwardly extending slotted ear 252 and the left hand corner of the bottom leg is provided with a forwardly extending slotted ear 254. Hanger 226 is formed of metal and an integral rib 256 spans the upper tapered part of opening 228 while an integral lateral rib 258 surrounds the lower rectangular part of the opening. The ribs 256 and 258 impart sufficient rigidity to the hanger 226 to prevent warping or twisting of the hanger about various vertical and horizontal axes while permitting access to the mass assembly, which comprises the wire 234 and the mass 242, through opening 228.

The spacer assembly 222, FIG. 13, is formed of plastic and is much thicker than the hanger 226. This assembly is of generally rectangular shape and defines an integral opening 260 which is generally aligned with the opening 228 when the spacer assembly is sandwiched between the mass assembly and the contact assembly as will be further described. The spacer assembly includes openings 262 in its upper left hand and right hand corner portions which are alignable with the openings 244 of plate 226. The side legs of the spacer assembly include integral oppositely extending pairs of ears 264 and 266, with the forwardly extending ears 264 and 266 being respectively received in openings 246 and 248 of hanger 226. The upper leg of the assembly is notched at 268 to provide clearance for tab 236 and the lower leg is slotted at 270, with this slot being alignable with slot 250 of hanger 226.

Figure 10:
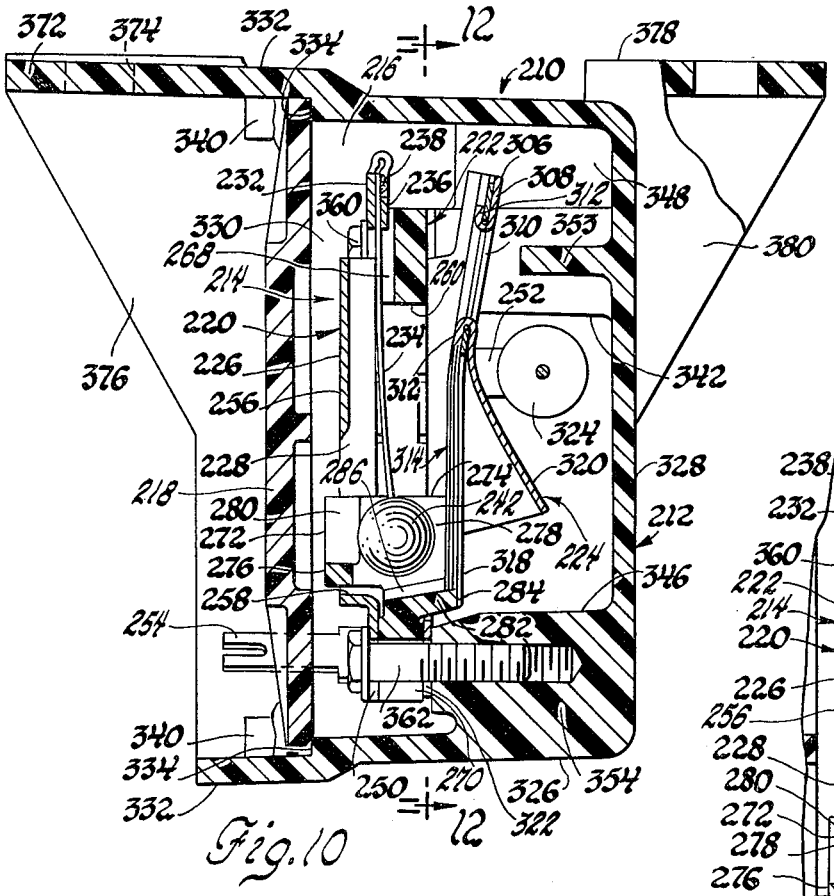
FIG. 10 is a sectional view taken generally along the plane indicated by line 10—10 of FIG. 8.

As best shown in FIGS. 9, 10 and 13, a mass housing 272, formed integral with the side legs of the spacer assembly at the lower end of the opening 260, includes a pair of angularly related legs 274 which extend to opposite sides of the opening 260 and have their forward ends interconnected by a leg 276. The inner walls of the legs 274 define a sector shaped recess 278 for receiving the mass 242, as will be described. The leg 276 as best shown in FIGS. 8 and 13 is provided with a slot 280 opening upwardly thereof. As best shown in FIG. 10, the lower leg of the spacer assembly is provided with an integral rearwardly extending lip 282, the rear edge 284 of which is formed on an arc having its point of generation coplanar with a bisector of the recess 278. It will be noted with reference to FIG. 10 that the upper wall 286 of lip 282 is formed at an angle of approximately 10° to the horizontal while the lower wall is formed at an angle of approximately 15° to the horizontal.

The contact assembly 224 includes a plate or hanger 288 of generally rectangular shape defining an opening 290. The hanger 288 includes openings 292 in its upper left hand and right hand corner portions which are alignable with the openings 262 of the spacer assembly and the openings 244 of hanger 226. The hanger 288 further includes openings 294 and 296 in its left hand and right hand side legs respectively, which respectively receive the rearwardly extending ears 264 and 266 and are alignable with the openings 246 and 248 of hanger 226. The left hand side leg is cut away at 298 and is generally alignable with a cutaway 300 of the left hand leg of the spacer assembly 222 to provide clearance for the slotted ear 252 of hanger 226. The right hand side leg of the plate is provided with a rearwardly extending slotted ear 302 and the right hand corner portion is provided with a forwardly extending slotted ear 304, with ear 302 being complementary to ear 252 and ear 304 being complementary to ear 254.

Figure 11:
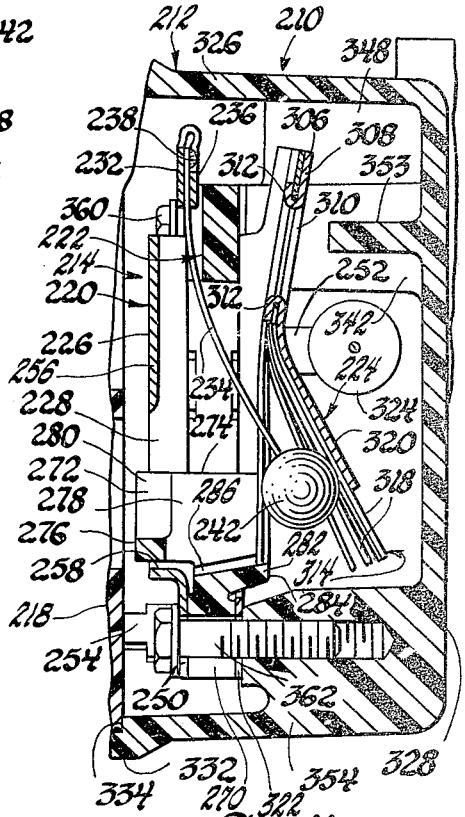
FIG. 11 is a view taken generally along the plane indicated by line 10—10 of FIG. 8 and showing the mass in actuated position.
Figure 12:
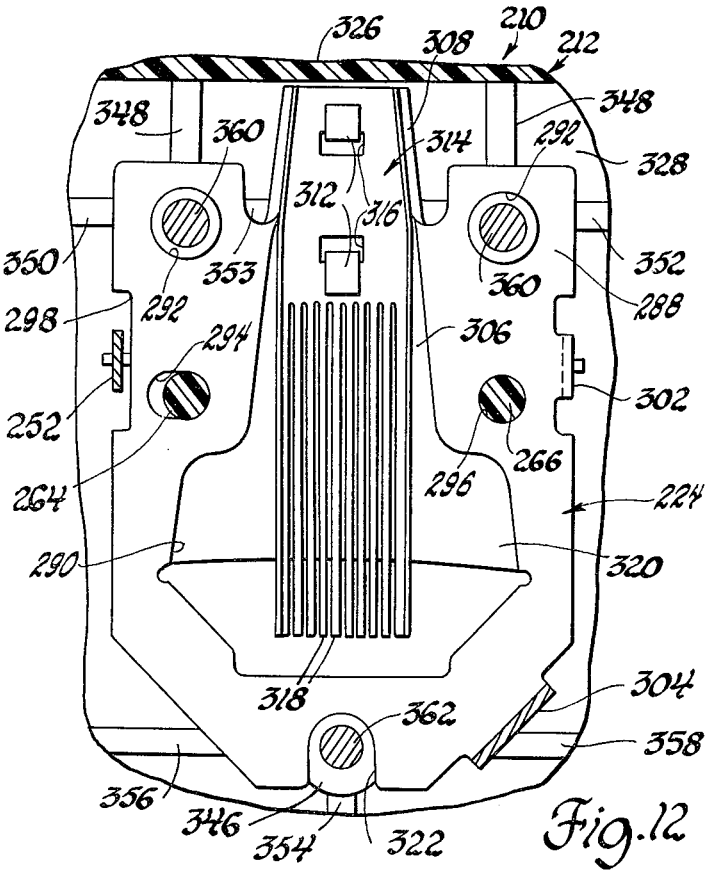
FIG. 12 is a view taken generally along the plane indicated by line 12—12 of FIG. 10.

An integral transverse arcuate leg 306 interconnects the side legs of hanger 226. The upper portion 308 of the leg is angled to the vertical at approximately 8°–10° as can be seen in FIGS. 10 and 11 and provided with a closed rectangular slot 310. A pair of integral lateral ears 312 extend from the upper and lower sides of the slot. A contact 314 has its body portion provided with a pair of slots 316 which receive ears 312. The ears are bent over the contact after assembly to secure the contact to the hanger. The contact 314 further includes a plurality of depending fingers 318 which are slightly spaced from each other as clearly shown in FIGS. 12 and 13.

The contact 314 is formed in the flat. When this contact is mounted on the leg 306 by the bent ears 312, the body portion of the contact assumes the arcuate cross-sectional shape of the upper portion 308 of leg 306. The fingers 318 engage the edge 284 of lip 282, FIG. 10, and assume an arcuate cross-sectional shape under a preload. The preload occurs from the angularity of the upper portion 308 of leg 306 to the vertical. The upper portions of the fingers bow slightly adjacent the body portion of the contact, FIG. 10.

As best shown in FIG. 10, the leg 306 further includes a lower portion 320 integral with the upper portion 308, of arcuate cross-section, and located angularly to the vertical. The lower portion 320 is normally spaced rearwardly of the contact fingers 318 and provides an ultimate stop for these fingers and for the mass 242 as will be further described. The lower leg of the hanger 288 is slotted at 322.

After the mass assembly 220, the spacer assembly 222 and the contact assembly 224 have been individually manufactured, they are assembled in a sensor module. The spacer assembly 222 is sandwiched between the mass assembly 220 and the contact assembly 224 with the apertures 244, 262 and 292; and the slots 250, 270 and 322; respectively aligned with each other.

The cutaways 300 and 298 of the spacer assembly 222 and hanger 288, respectively, provide clearance for ear 252 so that it can project rearwardly of the module in parallel spaced relationship to ear 302. The openings 246 and 294 are likewise aligned with each other and each receives a respective ear 264 of the spacer assembly. Likewise the elongated openings 248 and 296 are aligned with each other and each receives a respective ear 266 of the spacer assembly. The ears 264 and 266 are then loosely staked over the hangers 226 and 288 to thereby loosely secure the assemblies to each other in modular form. The staking generally secures the assemblies against lateral movement relative to each other while permitting some parallel shifting movement.

When the sensor module is assembled, the recess 278 of the mass housing 272 traverses the opening 228 of hanger 226. The mass 242 is received within the recess 278 in tangential engagement with the inner walls of the recess adjacent the proximal end thereof as shown in FIG. 9. The engagement of the mass with the walls of the recess deflects or bends the wire 234 from the vertical to thereby provide a preload on the mass locating the mass in its unactuated position as shown. In this embodiment, the mass is located in unactuated position by a preload of 5½ G and the natural frequency of the mass and the free portion of wire 234 is 30 Hz.

As best shown in FIG. 9, a resistor 324 is connected between the slotted ends of ears 252 and 302 by crimping the slotted ends about the resistor leads and then soldering the leads to the slotted ends.

The housing 212 is formed of molded plastic and includes a continuous integral outer wall 326, a base wall 328, and an intermediate wall 330 formed integrally with the base and outer walls and defining therewith the recesses 216. An integral offset flange 332 of wall 326 defines therewith a continuous shoulder 334 which seats the peripheral edge of the cover 218, FIGS. 8 and 9. The corner portions of flange 332 are provided with integral triangular posts 338, and semicircular posts 340 are provided at the junction of wall 330 and the flange 332. Three generally circular posts 342, 344 and 346 extend outwardly from the base wall 328 within each of the recesses 216. These posts are formed integral with the base wall, with posts 342 and 344 of each recess being connected to the upper portion of wall 326 and to wall 328 by integral webs 348. Posts 342 are further connected by integral webs 350 to walls 330 and 328, and the posts 344 are connected by integral webs 352 to wall 328 and to the side portions of wall 326. The posts 342 and 344 are connected to each other and wall 328 by web 353. The posts 346 are connected to the lower portion of wall 326 by integral webs 354, are connected by integral webs 356 to the wall 330, and are connected by webs 358 to the side portions of wall 326.

A sensor module 214 is located in each of the recesses 216 as shown in FIG. 8. The aligned groups of openings 244, 262 and 292 receive therethrough bolts 360 which are self-tapped within openings provided in the posts 342 and 344. The aligned slots 250, 270 and 322 receive therethrough a similar bolt 362 which is self-tapped within an opening in the post 346. Thus each module 214 is secured in place within its respective recess 216.

It will be recalled that ears 264 and 266 are staked over the hangers 226 and 288 in order to loosely assemble each of the modules. When the bolts 360 and 362 are driven in place, the mass assembly 220, the spacer assembly 222 and the contact assembly 224 are securely clamped to each other and to the housing 212. By providing a three point mounting of the sensor module 214 in this embodiment, rather than a four point mounting as in the first embodiment, possible distortion of the sensor module by being clamped to the housing is prevented.

It will also be recalled that the leg 276, which integrally connects the legs 274, is provided with a slot 280. After assembly of the sensor module 214 within the housing 212, the slot 280 permits a contact probe to engage the mass 242 and check both preload, spring rate, and mass travel distance to contact. The preload on the mass 242 can be easily calibrated after assembly by bending the upper leg 230 of hanger 226 together with the slotted tab 236 and the upper end of wire 234 as a unit about an axis designated A—A in FIG. 8.

The cover 218 is notched at its corner portions and along its upper and lower edges to receive the posts 338 and 340 therethrough. Once the peripheral edge of the cover is seated on shoulder 334, these posts are each staked over the peripheral edge of the cover as shown in FIG. 8 to tightly secure the cover to the housing and seal the housing against ambient conditions. The cover includes elongated sealed openings 364 which permit passage of the slotted ears 254 and 304 outwardly therethrough. These ears are connected to a suitable wiring harness, not shown, which connects the sensor assembly 210 to various actuation and monitor circuits across a source of power. The right hand side portion of flange 332 is provided with an ear 366 which is apertured at 368 and provided with a grooved passage 370 which receives the wiring harness. A generally flat cover plate, not shown, extends across the ear and is secured thereto by suitable fasteners extending through the openings 368 in order to secure the harness against movement relative to the sensor assembly 210.

As shown in FIGS. 8 and 10, the upper portion 372 of flange 332 extends outwardly beyond the lower portion of the flange and is apertured at 374 in order to provide for mounting of the sensor assembly on a device to be sensed. The upper portions 376 of the side portions of the flange are angled outwardly as shown in FIG. 10 in order to support the portion 372 of the flange. Further, as shown in FIG. 10, a rearwardly extending apertured flange 378 of the housing 212 is connected to the base wall by angular flanges 380 and provides for further mounting of the sensor assembly on the device to be sensed.

The movement of the mass 242 from its unactuated position shown in FIGS. 8 and 10 to its actuated position shown in FIG. 11 is the same as that previously described in conjunction with the first embodiment, except that the circuit is completed across the source of power and the device to be actuated through the slotted ears 254 and 304. The lower portion 320 of the arcuate leg 306 functions in the same manner as the leg 130 in providing an ultimate stop for the mass 242 and the engaged contact fingers 318. However, by forming the lower portion 320 integral with the upper portion 308 rather than forming these portions separate as in the first embodiment, the arcuate leg 306 continuously backs up the contact fingers 318 upon engagement of these fingers by the mass 242 and displacement of the fingers from their FIG. 10 position to their FIG. 11 position. This continuous backing up avoids any undue stress levels in the general area of the juncture of the fingers 318 with the body portion of the contact 314, and particularly immediately adjacent the lower bent ear 312.

Thus this invention provides an improved sensor assembly.

The embodiments of the invention in which an exclusive property or privilege is claimed are defined as follows:

1. A sensor module comprising, in combination, a generally planar mass assembly, a generally planar contact assembly, and a generally planar spacer assembly sandwiched between the mass assembly and the contact assembly, the mass assembly including a first hanger defining an enclosure, a pendulum supported mass on the first hanger movable laterally relative to the enclosure thereof, the spacer assembly defining an enclosure opening to the enclosure of the first hanger and further including a sector shaped recess defined by a pair of angularly related side walls extending generally laterally of the enclosures of the first hanger and spacer assembly, the mass being received within the recess in engagement with the side walls adjacent the proximal end of the recess to deflect the mass from normal position and provide a preload force, the contact assembly including a second hanger defining an enclosure opening to the spacer assembly enclosure and to the distal end of the recess, a contact mounted on the second hanger and including a plurality of deflectable contact fingers, means on the spacer assembly engageable by the contact fingers to deflect the contact fingers from normal position and provide a preload force on the fingers, means securing the first and second hangers to the spacer assembly to provide the sensor module, the mass moving within the sector shaped recess and into engagement with one or more contact fingers upon receipt by the mass of an acceleration pulse of predetermined amplitude and time to deflect the engaged contact fingers against the preload force on the fingers.

2. A sensor module comprising, in combination, a generally planar mass assembly, a generally planar contact assembly, and a generally planar spacer assembly sandwiched between the mass assembly and the contact assembly, the mass assembly including a first hanger defining an enclosure and including a bendable portion, a wire supported mass mounted on the bendable portion of the first hanger for movement laterally relative to the enclosure thereof, the spacer assembly defining an enclosure opening to the enclosure of the first hanger and further including a sector shaped recess defined by a pair of angularly related side walls extending generally laterally of the enclosures of the first hanger and spacer assembly, the mass being received within the recess in engagement with the side walls adjacent the proximal end of the recess to deflect the wire from normal position and provide a preload force on the mass, the deflection of the wire being set by bending of the bendable portion of the first hanger, the contact assembly including a second hanger defining an enclosure opening to the spacer assembly enclosure and to the distal end of the recess, a contact mounted on the second hanger and including a plurality of deflectable contact fingers, means on the spacer assembly located in an arc generated about a bisector of the recess and engageable by the contact fingers to deflect the contact fingers from normal position and provide a preload force on the fingers, means securing the first and second hangers to the spacer assembly to provide the sensor module, the mass moving within the sector shaped recess and into engagement with one or more contact fingers upon receipt by the mass of an acceleration pulse of predetermined amplitude and time to deflect the engaged contact fingers against the preload force on the fingers.

3. A sensor module comprising, in combination, a generally planar mass assembly, a generally planar contact assembly, and a generally planar spacer assembly sandwiched between the mass assembly and the contact assembly, the mass assembly including a first hanger defining an enclosure, a pendulum supported mass on the hanger movable laterally relative to the enclosure thereof, the spacer assembly defining an enclosure opening to the enclosure of the first hanger and further including a sector shaped recess defined by a pair of angularly related side walls and a base wall which extend generally laterally of the enclosures of the first hanger and spacer assembly, the mass being received within the recess in engagement with the side walls adjacent the proximal end of the recess to deflect the mass from normal position and provide a preload force, means providing access to the mass through the enclosure of the first hanger and between the side walls to check the preload force, the contact assembly including a second hanger defining an enclosure opening to the spacer assembly enclosure and to the distal end of the recess, a contact mounted on the second hanger and including a plurality of deflectable contact fingers, the base wall of the recess having an arcuate edge portion generated about a bisector of the recess and engageable by the contact fingers to deflect the contact finges from normal position and provide a preload force on the fingers, means securing the first and second hangers to the spacer assembly to provide the sensor module, the mass moving within the sector shaped recess and into engagement with one or more contact fingers upon receipt by the mass of an acceleration pulse of predetermined amplitude and time to deflect the engaged contact fingers against the preload force on the fingers.

4. A sensor module comprising, in combination, a wire supported mass mounted on the module for movement relative to the distal end of a sector shaped recess upon receipt thereby of an acceleration pulse of predetermined amplitude and time, a plurality of deflectable contact fingers mounted on the module, means locating the fingers in a partially deflected position adjacent the distal end of the recess for further deflection thereof upon engagement by the mass when the mass moves relative to the distal end of the recess, and ultimate stop means mounted on the module and located generally normal to the path of movement of the mass an in laterally spaced relationship to the fingers, the ultimate stop means being engageable by the contact fingers normal to the path of movement of the mass and opposite the engagement of the mass with the fingers to obviate any rotational turning moments on the mass tending to rotate the mass relative to the wire.

* * * * *